US012385706B2

(12) United States Patent
Gangl

(10) Patent No.: US 12,385,706 B2
(45) Date of Patent: Aug. 12, 2025

(54) BUTTON DETENT RETENSION METHOD FOR SPRING LOADED LINEAR ACTUATING DEVICE

(71) Applicant: J & K IP ASSETS, LLC, Cheyenne, WY (US)

(72) Inventor: Matthew Gangl, Hugo, MN (US)

(73) Assignee: J & K IP ASSETS, LLC, Cheyenne, WY (US)

( * ) Notice: Subject to any disclaimer, the term of this patent is extended or adjusted under 35 U.S.C. 154(b) by 0 days.

(21) Appl. No.: 18/351,793

(22) Filed: Jul. 13, 2023

(65) Prior Publication Data

US 2024/0019225 A1 Jan. 18, 2024

Related U.S. Application Data

(60) Provisional application No. 63/388,822, filed on Jul. 13, 2022.

(51) Int. Cl.
*F41A 17/38* (2006.01)

(52) U.S. Cl.
CPC ..... *F41A 17/38* (2013.01)

(58) Field of Classification Search
CPC ..... F41A 17/38; F41A 9/59
See application file for complete search history.

(56) References Cited

U.S. PATENT DOCUMENTS

| | | | | |
|---|---|---|---|---|
| 5,519,954 | A * | 5/1996 | Garrett | F41A 17/38 42/6 |
| 8,806,790 | B1 * | 8/2014 | Huang | F41A 17/74 42/70.08 |
| 8,943,866 | B2 * | 2/2015 | Fernandez | F41A 17/38 42/70.11 |
| 9,010,004 | B1 * | 4/2015 | Fu | F41A 17/38 42/6 |
| 9,121,651 | B1 * | 9/2015 | Jen | F41A 17/38 |
| 9,518,792 | B1 * | 12/2016 | Huang | F41A 35/00 |
| 10,060,690 | B1 * | 8/2018 | Huang | F41A 17/38 |
| 10,378,840 | B1 * | 8/2019 | Huang | F41A 17/44 |
| 10,690,426 | B1 * | 6/2020 | Huang | F41A 9/59 |
| 10,753,696 | B1 * | 8/2020 | Christopher | F41A 17/42 |
| 11,248,867 | B2 * | 2/2022 | Lee | F41A 17/38 |
| 12,085,349 | B2 * | 9/2024 | Schrödl | F41A 35/06 |
| D1,046,054 | S * | 10/2024 | DiMuzio | D22/108 |
| 2016/0069628 | A1 * | 3/2016 | Fluhr | F41A 35/06 42/6 |

* cited by examiner

*Primary Examiner* — Derrick R Morgan
(74) *Attorney, Agent, or Firm* — Haynes and Boone, LLP; William B. Nash

(57) ABSTRACT

Systems, device, and methods for assembling a magazine catch device are provided which may include providing a threaded rod, providing a button base that is configured to be place along the threaded rod, and threading a button onto the threaded rod such that a first set of surfaces of the button matches up with and bears against a second set of surfaces of the button base to align the button base and the button when tension is applied to the button base and button.

20 Claims, 9 Drawing Sheets

BUTTON DETENT RETENSION METHOD FOR SPRING LOADED LINEAR ACTUATING DEVICE

CROSS-REFERENCE TO RELATED APPLICATIONS

The present application claims priority to U.S. Provisional Patent No. 63/388,822, filed on Jul. 13, 2022, the entirety of which is hereby incorporated by reference in its entirety.

TECHNICAL FIELD

The present invention relates to methods, devices, and systems for installation and retention of a button into a magazine catch device. The invention is applicable in a wide array of applications requiring a robust, simple, and easily installable method of attaching a button to a magazine catch device which may be spring-loaded. This may be implemented in an AR style firearm.

BACKGROUND

Various mechanical devices, including certain types of firearms, use linear actuator devices with a retained button-shaped element. These are often used with spring loaded devices to provide consistent pressure. In the application of some firearms used for competition, a larger button interface is used to aid in faster engagement. However, the ability to use an enlarged button on a magazine catch is hindered by the installation method of the magazine catch. Specifically, the button of some conventional magazine catches must be over-depressed into the receiver during installation. This over-depression often interferes with the enlarged button, and in particular, would require the button to be taller to allow for sufficient clearance within the receiver of the firearm.

In an effort to overcome this problem, designers have utilized a number of work-arounds that include multi-piece button assemblies. However, these generally require screws, dovetails, and other mechanical attachment methods for a button extension. These can create problems of their own, such as additional costs and complexity of manufacturing additional attachments such as dovetails. They can also suffer from the tendency of mechanical fastening devices such as screws to come loose over time, especially in high vibration environments such as firearms, leading to alignment issues and damage to other systems from loose components.

Thus, needs exist for a robust, secure, and mechanically simple solution to retaining a button in a spring-loaded linear device.

SUMMARY

The systems, devices, and methods disclosed herein relate generally to retaining a button in a magazine catch device. A magazine catch is provided, which may include: a rod extending along a longitudinal axis, the rod comprising threads on a first end and a bar on a second end; a button base with a bore extending therethrough, wherein the rod is configured to extend through the bore of the button base; a spring disposed around the rod, wherein a first end of the spring contacts the button base and a second end of the spring bears against a receiver; and a button comprising a first end with a planar profile and a second end with internal threads which are configured to be threaded onto the rod, the button comprising an extension configured to be placed within the button base, wherein a first set of surfaces on the button base are configured to match up with a second set of surfaces on the button such that pressure aligns the button base and the button, wherein the receiver restrains rotational motion of the bar relative to the button base.

In some implementations, magazine catch is configured to be installed within a receiver of a firearm. The first set of surfaces may include a conic profile. The second set of surfaces may include a conic profile. The second set of surfaces may include an elliptical profile. The first set of surfaces and second set of surfaces may be arranged to allow rotation of the button over a specified angular range.

In some implementations, the first set of surfaces includes a first surface extending at a first angle that is normal to the longitudinal axis of the rod and a second surface extending at a second angle that that is not normal to the longitudinal axis of the rod. The second set of surfaces may include a third surface extending at the first angle that is normal to the longitudinal axis of the rod and a fourth surface extending at the second angle that that is not normal to the longitudinal axis of the rod. The first set of surfaces may include a surface extending around an entire perimeter of a first side of the button base. The first set of surfaces and the second set of surfaces may have a sawtooth shaped profile.

A magazine catch configured for a firearm is also provided, which may include: a threaded rod extending along a longitudinal axis, wherein the threaded rod is configured to extend through a button base; a spring disposed around the threaded rod and configured to contact the button base and provide tension on the button base; and a button with a first set of surfaces configured to contact a second set of surfaces of the button base along a contact profile to align the button base and button, wherein the button is configured to be threaded onto the threaded rod.

In some implementations, the first set of surfaces includes a conic profile. The second set of surfaces may include a conic profile. The first set of surfaces may include a first surface extending at a first angle that is normal to the longitudinal axis of the threaded rod and a second surface extending at a second angle that that is not normal to the longitudinal axis of the threaded rod. The second set of surfaces may include a third surface extending at the first angle that is normal to the longitudinal axis of the threaded rod and a fourth surface extending at the second angle that that is not normal to the longitudinal axis of the threaded rod. The first set of surfaces may include a surface extending around an entire perimeter of a first side of the button base. The first set of surfaces and second set of surfaces may have a sawtooth shaped profile.

A method for assembling a magazine catch is also provided which may include: providing a threaded rod extending along a longitudinal axis; providing a button base comprising a bore extending therethrough and a first set of surfaces; placing the rod within the button base such that it extends through the bore; providing a button comprising internal threads and a second set of surfaces that are configured to match up with the first set of surfaces; and threading the button onto the threaded rod via the internal threads such that the first set of surfaces of the button base contacts the second set of surfaces of the button and provides pressure to align the button base and the button along the longitudinal axis.

In some implementations, the method includes a step to install a spring around the threaded rod, such that the spring provides tension to an end of the button base opposite the first set of surfaces. The first and second sets of surfaces may include a conic profile.

It is to be understood that both the foregoing general description and the following detailed description are exemplary and explanatory in nature and are intended to provide an understanding of the present disclosure without limiting the scope of the present disclosure. In that regard, additional aspects, features, and advantages of the present disclosure will be apparent to one skilled in the art from the accompanying drawings and the following detailed description.

BRIEF DESCRIPTION OF THE DRAWINGS

The accompanying drawings illustrate implementations of the devices and methods disclosed herein and together with the description, serve to explain the principles of the present disclosure.

Figure 1:
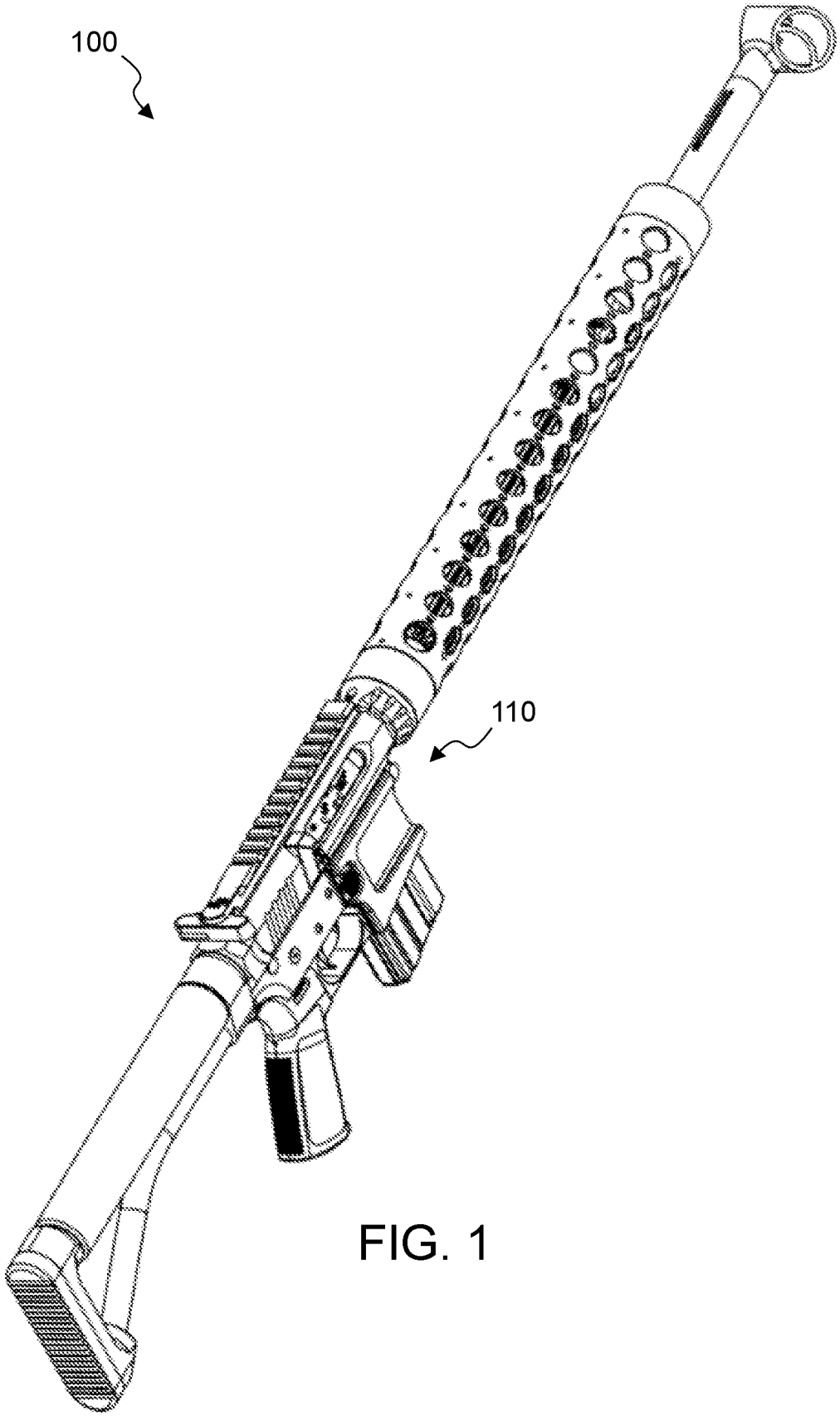
FIG. 1 illustrates an AR style firearm with a complete assembly.

The accompanying drawings may be better understood by reference to the following detailed description.

DETAILED DESCRIPTION

For the purposes of promoting an understanding of the principles of the present disclosure, reference will now be made to the implementations illustrated in the drawings. Specific language will be used to describe the same. It will nevertheless be understood that no limitation of the scope of the disclosure is intended. Any alterations and further modifications to the described devices, systems, methods, and any further application of the principles of the present disclosure are fully contemplated as would normally occur to one skilled in the art to which the disclosure relates. In particular, it is fully contemplated that the features, components, and/or steps described with respect to one implementation may be combined with the features, components, and/or steps described with respect to other implementations of the present disclosure. For simplicity, in some instances the same reference numbers are used throughout the drawings to refer to the same or like parts.

The present disclosure relates generally to magazine catch devices that are configured to be used with tension, such in a spring loaded configuration. These magazine catch devices may be used in firearms. The present disclosure may offer benefits over magazine catch devices.

A two-piece button design is presented herein that allows for a button installation onto a captive spring-loaded linear actuating assembly. In some implementations, the linear actuating assembly may be used on a magazine catch for an AR style firearm. The present invention may replace the conventional single piece button used on an AR magazine catch with a two piece design, and in particular, with a button base and button that fit together. This new design may circumvent the need to over-depress the button into the receiver during installation which in turn allows for a greater variety of shapes and sizes to the button. In some implementations, the two-piece design includes a mating detent surface between the two parts that acts with the conventional magazine catch spring to retain the external button rather than the receiver itself.

Therefore, the present disclosure meets the existing needs for a robust, secure, and mechanically simple solution to retaining a button in a magazine catch device.

FIG. 1 illustrates an AR style firearm 100 with a complete assembly including a receiver 110. Some implementations of the present invention may be suitable for use in such a firearm 100, and in particular, may be integrated into the receiver 110.

Figure 2A:
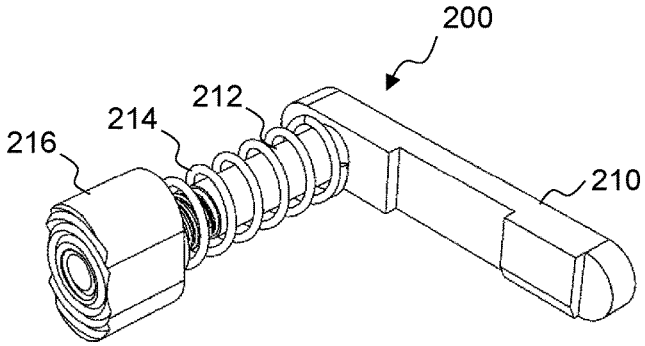
FIG. 2A illustrates a conventional magazine catch.

FIG. 2A illustrates a conventional magazine catch 200 that may be used with the firearm 100 shown in FIG. 1. The magazine catch 200 includes a device 210 which may be referred to as a bar or catch, rod 212, a spring 214, and button 216.

Figure 2B:
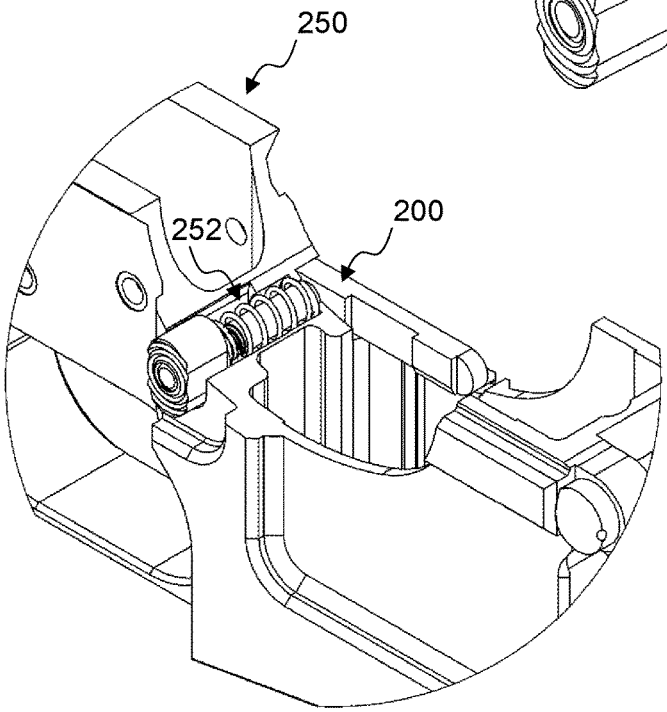
FIG. 2B illustrates an internal view of a conventional magazine catch in its normal resting state, installed in an AR lower receiver.

FIG. 2B illustrates an internal view of the conventional magazine catch 200 in its normal resting state, installed in an AR lower receiver 250. The magazine catch 200 may be placed inside a bore 252 of the receiver.

Figure 2C:
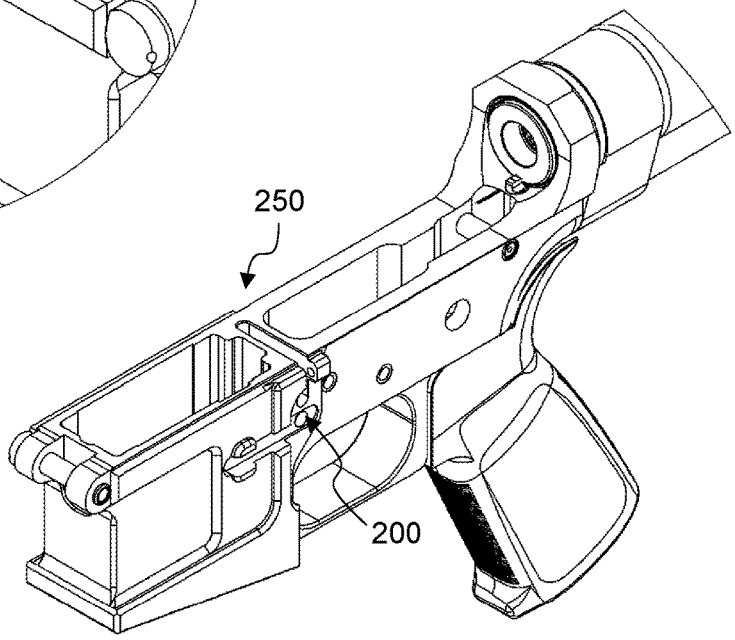
FIG. 2C illustrates an external view of a conventional magazine catch in its normal resting state, installed in an AR lower receiver.

FIG. 2C illustrates an external view of the conventional magazine catch 200 in its normal resting state, installed in the AR lower receiver 250. As shown in this figure, the bar 210 of the magazine catch 200 is visible from the exterior of the receiver 250.

Figure 3A:
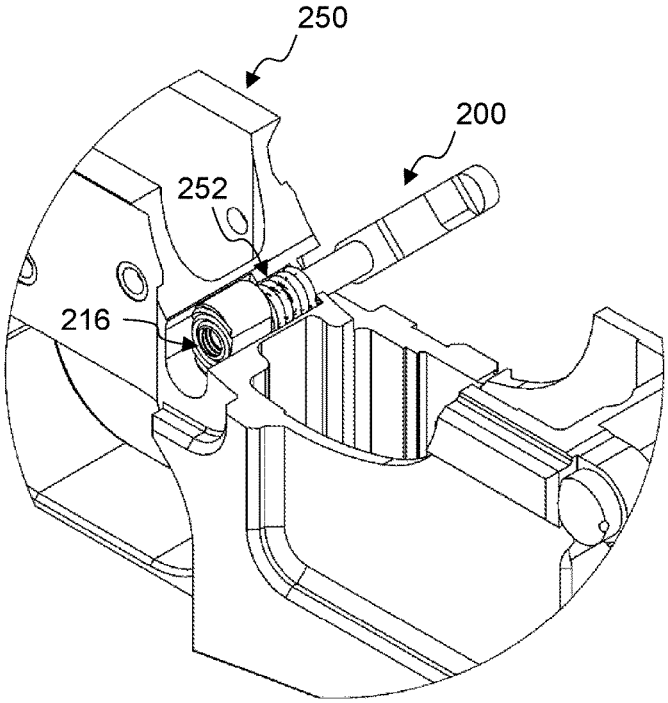
FIG. 3A illustrates an internal view of a conventional magazine catch being installed in an AR lower receiver.
Figure 3B:
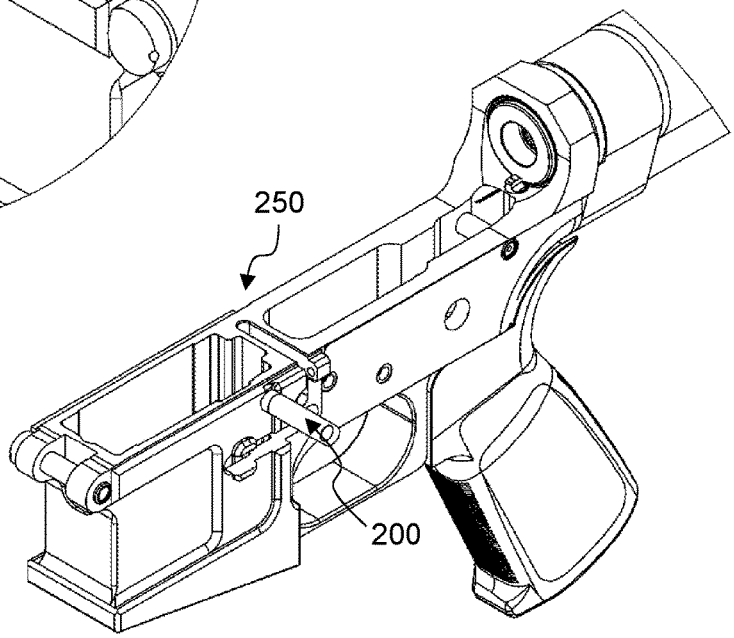
FIG. 3B illustrates an external view of a conventional magazine catch being installed in an AR lower receiver.

FIGS. 3A-3B illustrate an internal view of a conventional magazine catch 200 being installed in the AR lower receiver 250. During installation, the button 216 of the magazine catch 200 must be over-depressed to fit into the lower receiver 250.

Figure 4A:
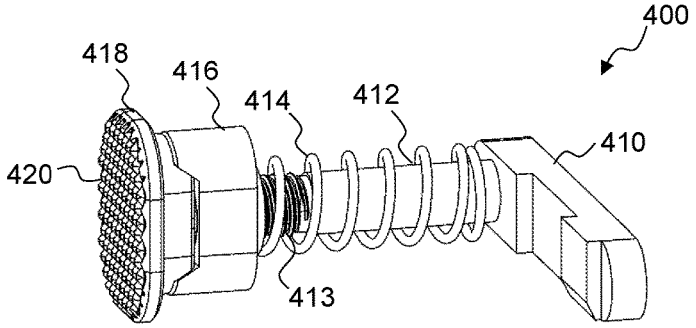
FIG. 4A illustrates an exemplary magazine catch in a normal resting state according to implementations of the present disclosure.

FIG. 4A illustrates an exemplary magazine catch device of the present invention. Although the magazine catch may be implemented in many different contexts, in the examples of FIGS. 4A-8C, the magazine catch 400 may be suitable for use in a firearm, such as the AR style firearm 100 shown in FIG. 1. The magazine catch 400 may include a rod 412 featuring a central axis extending therethrough. The rod 412 may also include threads 413 disposed on a distal end. The threads 413 may be concentric to the central axis along one end or the entirety of the rod 412. The bar 410 may be disposed on a proximal end of the rod 412. In some implementations, a spring 414 encircles the rod 412.

In some implementations, a button base 416 abuts the button 418 and includes a bore 428 which extends through a central portion of the button base 416. In some implementations, the rod 412 passes through this bore 428 such that the button base 416 is constrained to moving longitudinally along the central axis of the rod 412. The receiver 250 may restrain rotation of the bar 410 relative to the button base 416. The bore 428 may facilitate the integration of the rod 412 with the button 418. In some implementations, the location of the bore 428 places the button base 416 in between the button 418 and the threads 413 of the rod 412.

The button base 416 may also include a proximal end 427 which may have a planar shape configured to bear against the spring 414 and a distal end 424.

In some implementations, the shaped central portion 421 of the button 418 and the distal end 424 of the button base 416 have a common profile that is parallel, but not concentric to the central axis of the threaded rod. This profile may be cut into a slot shaped area of the button base 416, such that the button 418 is free to move along the axis of the rod 412 longitudinally, but is restrained from free rotation at a specified angle by the geometry of the profile.

Figure 4B:
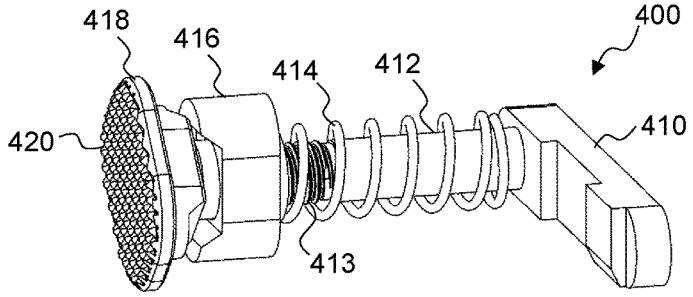
FIG. 4B illustrates an exemplary magazine catch in a state of installation according to implementations of the present disclosure.
Figure 4C:
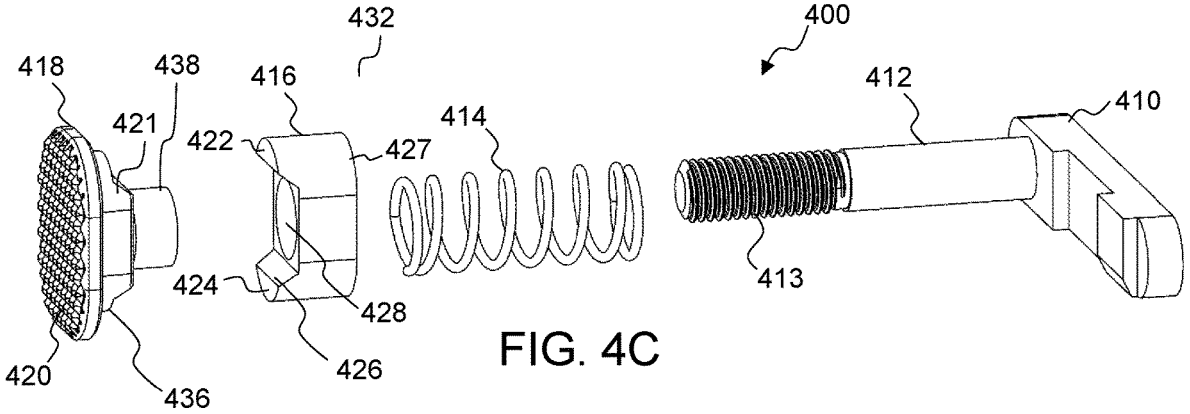
FIG. 4C is an exploded view of an exemplary magazine catch according to implementations of the present disclosure.
Figure 5A:
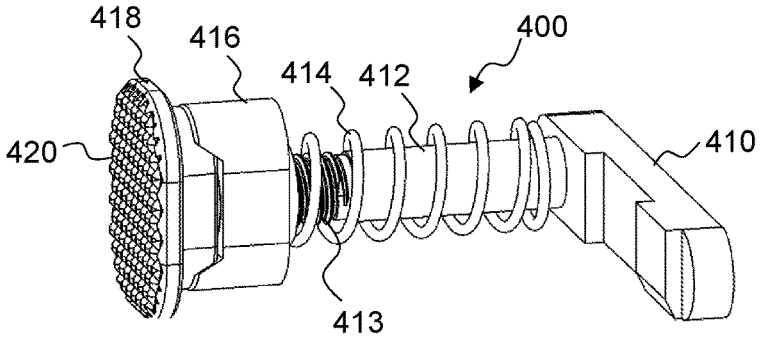
FIG. 5A illustrates an exemplary magazine catch in a normal resting state according to implementations of the present disclosure.
Figure 5B:
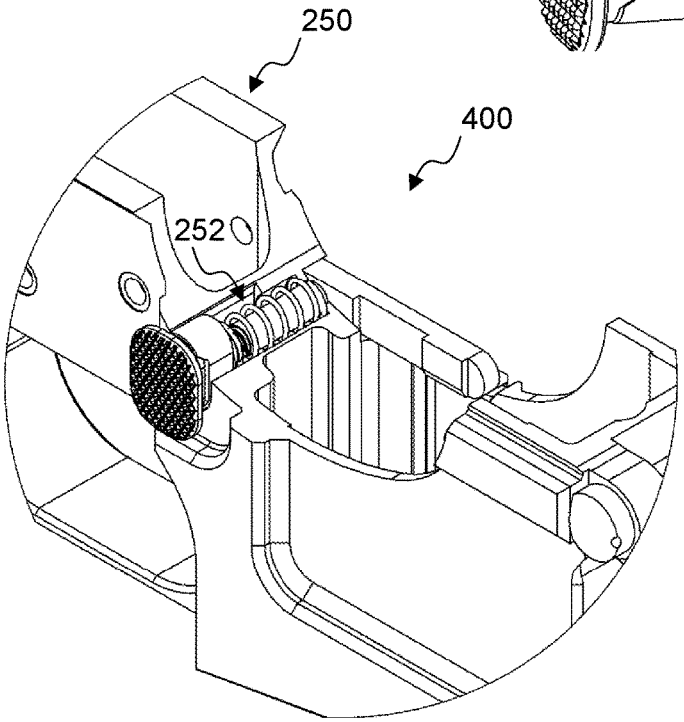
FIG. 5B illustrates an internal view of an exemplary magazine catch in a normal resting state, installed in an AR lower receiver according to implementations of the present disclosure.
Figure 6A:
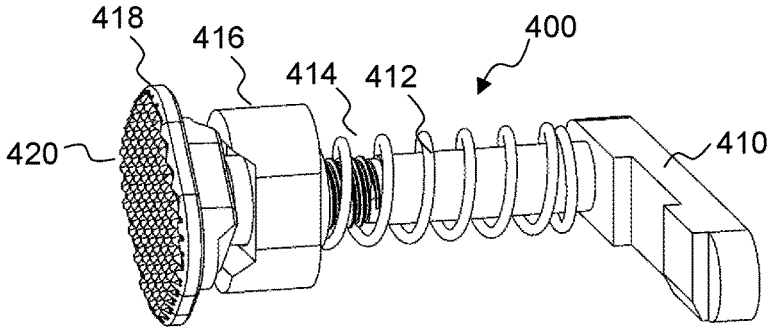
FIG. 6A illustrates an exemplary magazine catch in a state of installation according to implementations of the present disclosure.
Figure 6B:
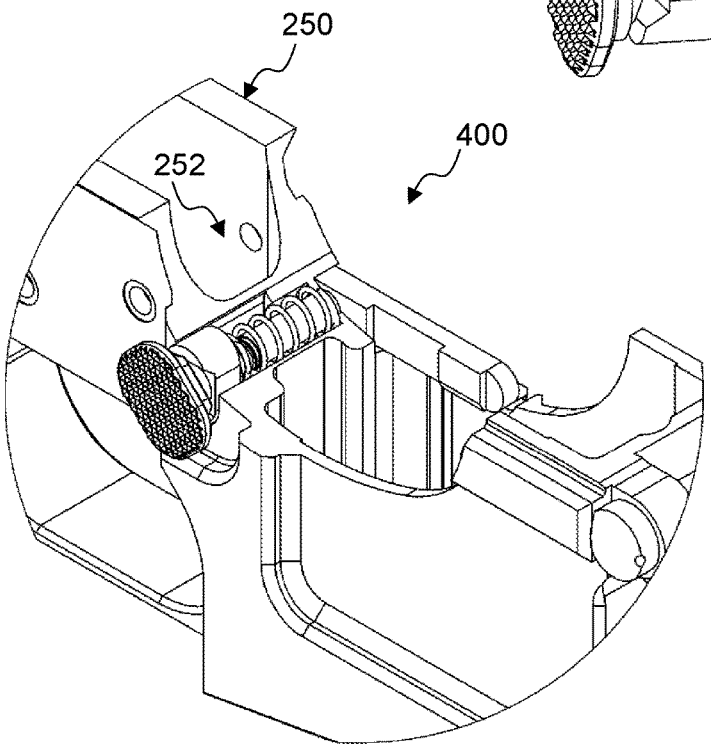
FIG. 6B illustrates an internal view of an exemplary magazine catch being installed in an AR lower receiver according to implementations of the present disclosure.

In some implementations, the distal end 424 of the button base 416 includes one or more sloped surfaces 426 and one or more flat surfaces 422 which are configured to meet with the shaped central portion 421 of the button 418. In the example of FIGS. 4A-4C, the distal end 424 of button base 416 includes two flat surfaces 422 at the ends of the button base 416 and sloped surfaces 426 which slope down from the flat surfaces 422 to other surfaces around the bore 428. These surfaces 422, 426 may be configured to provide a stable, movable connection to the shaped central portion of the button 418 when pressure is applied to the magazine catch 400.

The surfaces 422, 426, 436 of the button base 416 and button 418 may feature detent mating surfaces. These surfaces 422, 426, 436 may have a defined height as taken along the central axis of the threaded rod. In some implementations, the surfaces 426 and 436 are non-parallel, non-perpendicular and non-concentric to the central axis of the rod 412. Surfaces 422 may be perpendicular to the rod 412. They may be shaped such that if the button 418 is rotated against the button base 416, the interaction of the surfaces 422, 426, 436 force the button 418 and button base 416 apart a distance that is approximately equal to the defined height. This separation can be achieved via a number of methods, including: surfaces that feature a linear boss and groove, a boss and recess, knurling, and other such geometry. Thus, in some implementations, when the button 418 is rotated, it pushes the button base 416 away, compressing the spring 414 such that the spring 414 provides resistance against rotation when the surfaces 422, 426, 436 are in alignment. Rotation of the button 418 is shown in FIGS. 5A-6B as the magazine catch 400 is installed in a receiver 250.

The distal end of the rod 412 may be attached to the button 418. In the example of FIGS. 4A-4C, the button 418 has a distal end 420 with a textured, planar shape, a shaped central portion 421, and a distal end 438 which extends out from the shaped central portion 421. In some implementations, the distal end 438 is configured to extend within the bore 428 of button base 416. The central portion 421 may include various flat and sloped surfaces 436 which correspond to the various surfaces 422, 426 of the distal end 424 of the button base 416 and allow for a firm, partially rotatable connection between the button base 416 and button 418.

In some implementations, the button 418 is constrained from fully rotation in the button base 416 but allowed to rotate for a specified amount (as shown in FIG. 4B). In this case, the button 418 is out of detent with the button base 416. In some implementations, the surfaces 422, 426 keep the button 418 and button base 416 in alignment such that rotation is constrained. However, in some implementations, there is some angular range where the button base 416 is camming out/in of detent lock as well as a second angular range where the button base 416 can rotate freely fully out of detent.

In some implementations, the button 418 functions as a button type device attached to the rest of the magazine catch 400. The button 418 may include internal threads that match with the threads 413 of the rod 412.

The spring 414 may be placed and sized such that it can act to press the button base 416 and button 418 in a distal direction by applying pressure on the proximal end of the button base 416. This may place the button 418 and button base 416 in tension against the threads 413 (or other connection device between the button and rod 412) such that the mating surfaces of the button 418 and button base 416 rest against each other. The spring 414 may be a coil spring with a central axis coincident with the central axis of the threaded rod and may be arranged such that its distal end rests on the proximal end of the button base 416 and its proximal end rests against the receiver 250.

In some implementations, the arrangement of elements in the magazine catch 400 allows for the installation of the button 418 and button base 416 by simply threading the button 418 onto the threads 413 of the rod 412 over the button base 416 and spring 414 until the button base 416 and button 418 are rotationally captive within the receiver 250. For example, the button base 416 has a profile that keys into a mating bore within the receiver to prevent rotation. The detent surfaces between the button base 416 and button 418 may prevent the button 418 from passively unthreading by vibration or accidental impact.

Figure 7A:
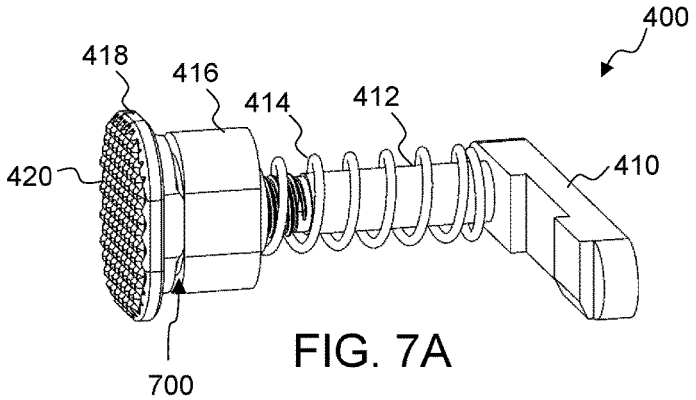
FIG. 7A illustrates a second exemplary magazine catch in a normal resting state according to implementations of the present disclosure.
Figure 7B:
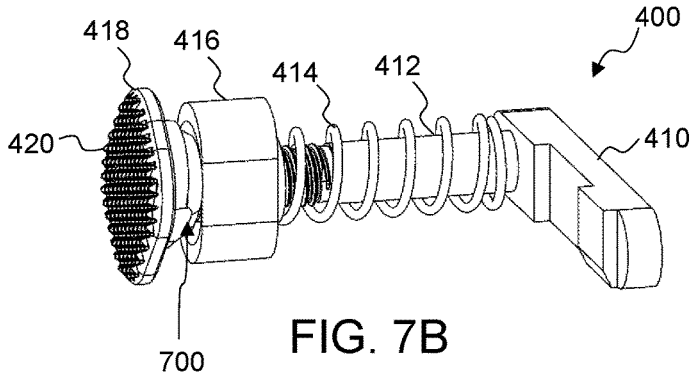
FIG. 7B illustrates a second exemplary magazine catch in a state of installation according to implementations of the present disclosure.
Figure 7C:
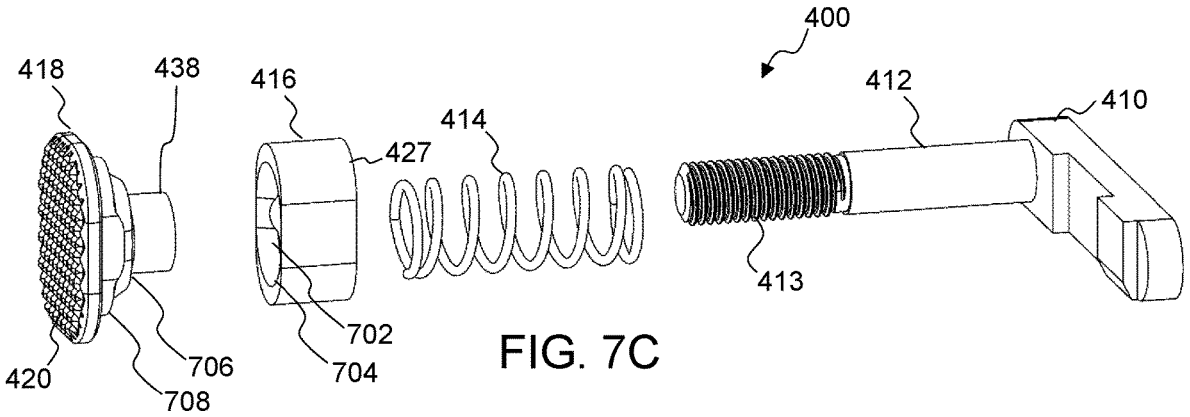
FIG. 7C is an exploded view of a second exemplary magazine catch according to implementations of the present disclosure.

FIGS. 7A-7C shows a second implementation of a magazine catch featuring an alternative mating surface 700 between the button base 416 and button 418. In these examples, the button base 416 may include a flat surface 704 extending around the perimeter of the button base 416 as well as internal sloped surfaces 702 that match up with corresponding surfaces 706, 708 of the button 418. Similar to the implementation shown in FIGS. 4A-6B, in this implementation, when the button 418 is rotated, it pushes the button base 416 away, compressing the spring 414 such that the spring 414 provides resistance against rotation when the surfaces 702, 704, 706, 708 are in alignment.

Figure 8A:
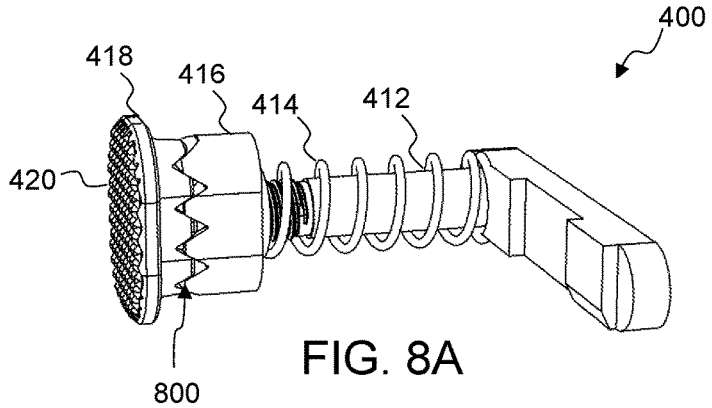
FIG. 8A illustrates a third exemplary magazine catch in a normal resting state according to implementations of the present disclosure.
Figure 8B:
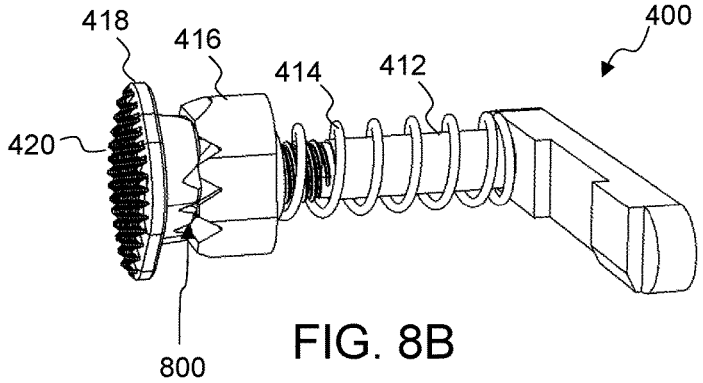
FIG. 8B illustrates a third exemplary magazine catch in a state of installation according to implementations of the present disclosure.
Figure 8C:
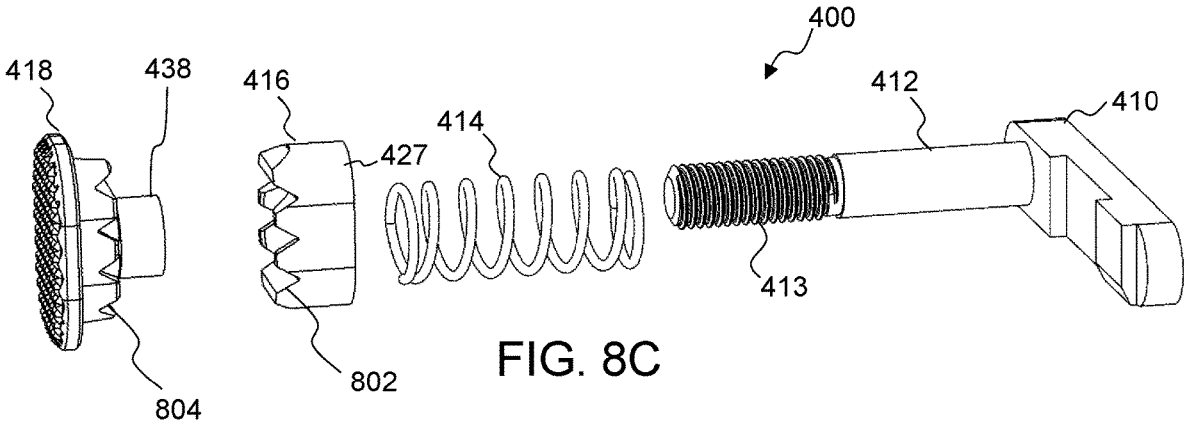
FIG. 8C is an exploded view of a third exemplary magazine catch according to implementations of the present disclosure.

FIGS. 8A-8C shows a third implementation of a magazine catch 400 featuring an alternative mating surface 800 between the button base 416 and button 418. In these examples, the button base 416 may include sloped surfaces 802 in a sawtooth shape that match up with corresponding surfaces 804 of the button 418. Similar to the implementations shown in FIGS. 4A-6B and 7A-7C, in this implementation, when the button 418 is rotated, it pushes the button base 416 away, compressing the spring 414 such that the spring 414 provides resistance against rotation when the surfaces 802, 804 are in alignment.

Figure 9:
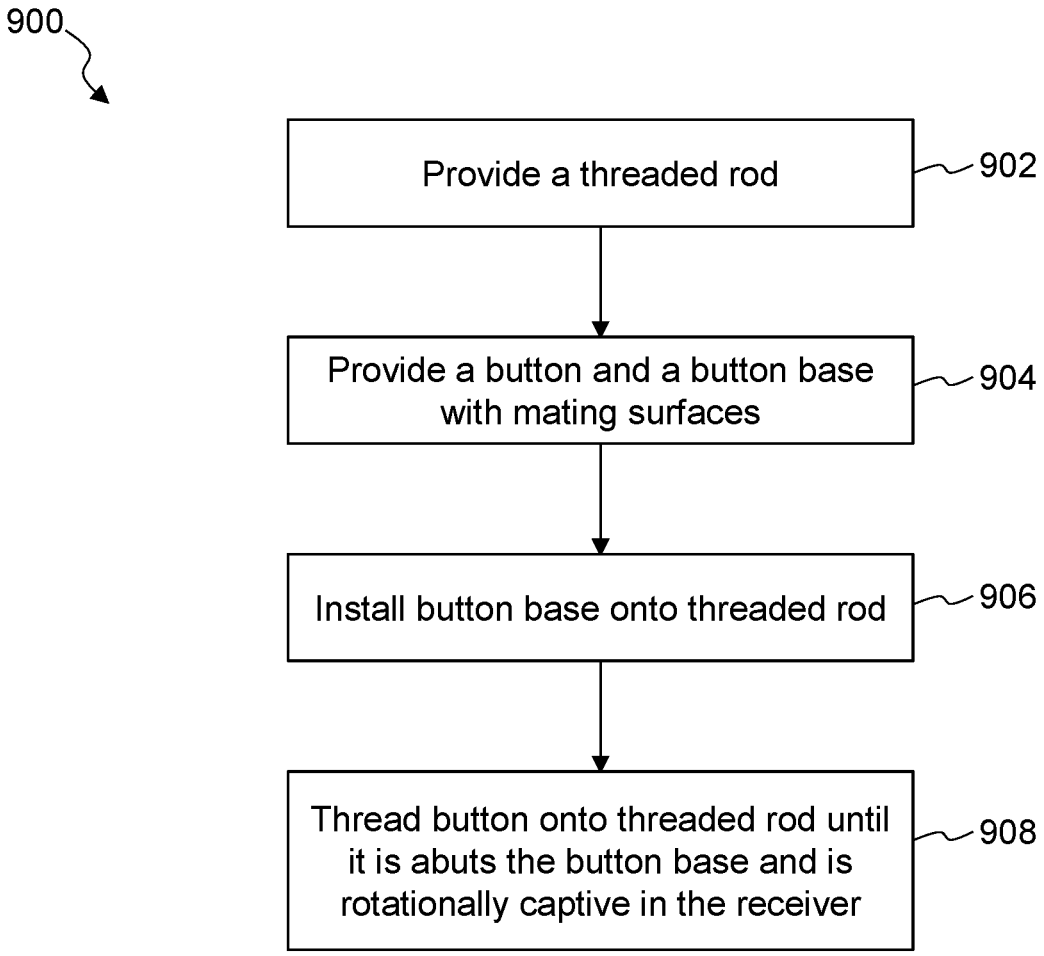
FIG. 9 illustrates a flow chart for installing an exemplary magazine catch in a firearm receiver according to implementations of the present disclosure.

FIG. 9 shows an exemplary method 900 or installing a magazine catch as shown in any of FIGS. 4A-8C. Method 900 may start with a step 904 to provide a threaded rod such as rod 412. This rod 412 may be installed in the receiver of a firearm. The method may continue with step 904 to provide a button (such as button 418) and a button base (such as button base 416). These devices may include corresponding surfaces that are configured to mate together and provide pressure between the devices.

The method may include a step 906 to install the button base onto the threaded rod. In some implementations, the button base includes a threaded bore which the rod may extend through. A spring may be installed around the rod such that it bears against the button base when it is installed on the rod. The spring may also bear against the receiver.

The method 900 may include a step 908 to thread the button onto the threaded rod. In some implementations, the button includes internal threads that match up with the external threads of the threaded rod. The button may then be rotated around until it is adjacent to the button base such that the corresponding surfaces of the button base and button are in contact and the button base is rotationally captive in the receiver. The tension provided by the spring or other tensioning device may then keep the button base and button aligned in the rest state, and may help to prevent the button from passively unthreading from the threaded rod when vibrations or accidental impacts occur. This also allows the button to rotate a specified amount when pressure is applied and the button base is camming out of detent lock.

Persons of ordinary skill in the art will appreciate that the implementations encompassed by the present disclosure are not limited to the particular exemplary implementations described above. In that regard, although illustrative implementations have been shown and described, a wide range of modification, change, and substitution is contemplated in the foregoing disclosure. It is understood that such variations may be made to the foregoing without departing from the scope of the present disclosure. Accordingly, it is appropriate that the appended claims be construed broadly and in a manner consistent with the present disclosure.

What is claimed is:

1. A magazine catch, comprising:

a rod extending along a longitudinal axis, the rod comprising threads on a first end and a bar on a second end;

a button base with a bore extending therethrough, wherein the rod is configured to extend through the bore of the button base;

a spring disposed around the rod, wherein a first end of the spring contacts the button base and a second end of the spring bears against a receiver; and a button comprising a first end with a planar profile configured to be pressed by a user to release a magazine and a second end with internal threads which are configured to be threaded onto the rod, the first end with the planar profile and the second end with the internal threads being integrally formed, the button comprising an extension configured to be placed within the button base, wherein during rotation of the button a first set of surfaces on the button base are configured to engage with a second set of surfaces on the button such that pressure aligns the button base and the button, wherein the receiver restrains rotational motion of the bar relative to the button base.

2. The magazine catch of claim 1, wherein the magazine catch is configured to be installed within a receiver of a firearm.

3. The magazine catch of claim 1, wherein the first set of surfaces includes a conic profile.

4. The magazine catch of claim 1, wherein the second set of surfaces includes a conic profile.

5. The magazine catch of claim 1, wherein the second set of surfaces includes an elliptical profile.

6. The magazine catch of claim 1, wherein the first set of surfaces and second set of surfaces are arranged to allow rotation of the button over a specified angular range.

7. The magazine catch of claim 4, wherein the first set of surfaces comprises a first surface extending at a first angle that is normal to the longitudinal axis of the rod and a second surface extending at a second angle that that is not normal to the longitudinal axis of the rod.

8. The magazine catch of claim 7, wherein the second set of surfaces comprises a third surface extending at the first angle that is normal to the longitudinal axis of the rod and a fourth surface extending at the second angle that that is not normal to the longitudinal axis of the rod.

9. The magazine catch of claim 1, wherein the first set of surfaces comprises a surface extending around an entire perimeter of a first side of the button base.

10. The magazine catch of claim 1, wherein the first set of surfaces and the second set of surfaces have a sawtooth shaped profile.

11. A magazine catch configured for a firearm, comprising:

a threaded rod extending along a longitudinal axis, wherein the threaded rod is configured to extend through a button base;

a spring disposed around the threaded rod and configured to contact the button base and provide tension on the button base; and a button with a first set of surfaces configured to contact a second set of surfaces of the button base along a contact profile to align the button base and button, wherein the button is configured to be threaded onto the threaded rod such that during rotation of the button, the first and second surfaces are engaged and are configured to drive the button base against the spring.

12. The magazine catch of claim 11, wherein the first set of surfaces includes a conic profile.

13. The magazine catch of claim 11, wherein the second set of surfaces includes a conic profile.

14. The magazine catch of claim 11, wherein the first set of surfaces comprises a first surface extending at a first angle that is normal to the longitudinal axis of the threaded rod and a second surface extending at a second angle that that is not normal to the longitudinal axis of the threaded rod.

15. The magazine catch of claim 14, wherein the second set of surfaces comprises a third surface extending at the first angle that is normal to the longitudinal axis of the threaded rod and a fourth surface extending at the second angle that that is not normal to the longitudinal axis of the threaded rod.

16. The magazine catch of claim 11, wherein the first set of surfaces comprises a surface extending around an entire perimeter of a first side of the button base.

17. The magazine catch of claim 11, the first set of surfaces and second set of surfaces have a sawtooth shaped profile.

18. A method for assembling a magazine catch, comprising:

providing a threaded rod extending along a longitudinal axis;

providing a button base comprising a bore extending therethrough and a first set of surfaces non-parallel to the longitudinal axis;

placing the rod within the button base such that the rod extends through the bore;

providing a button comprising internal threads and a second set of surfaces non-parallel to the longitudinal axis that are configured to match up with the first set of surfaces; and threading the button onto the threaded rod via the internal threads, during rotation of the button the first set of surfaces of the button base contacts the second set of surfaces of the button and provides pressure to align the button base and the button along the longitudinal axis.

19. The method of claim 18, further comprising a step to install a spring around the threaded rod, such that the spring provides tension to an end of the button base opposite the first set of surfaces.

20. The method of claim 18, wherein the first and second sets of surfaces comprise a conic profile.

* * * * *